US005165041A

United States Patent [19]

Bjerke et al.

[11] Patent Number: 5,165,041

[45] Date of Patent: Nov. 17, 1992

[54] FRANGIBLE SABOT

[75] Inventors: Todd W. Bjerke, Bel Air; William R. Edmanson, Jr., Elkton, both of Md.

[73] Assignee: The United States of America as represented by the Secretary of the Army, Washington, D.C.

[21] Appl. No.: 800,898

[22] Filed: Dec. 3, 1991

[51] Int. Cl.[5] ..... F42B 8/14; F42B 14/06

[52] U.S. Cl. ..... 102/520

[58] Field of Search ..... 102/520, 521, 522, 506, 102/529

[56] References Cited

U.S. PATENT DOCUMENTS

| | | | |
|---|---|---|---|
| 2,820,412 | 1/1958 | Beeuwkes, Jr. et al. | 102/522 |
| 3,005,408 | 10/1961 | Prosen et al. | 102/522 |
| 3,212,208 | 10/1965 | Persechino et al. | 102/521 |
| 4,000,698 | 1/1977 | Corney | 102/93 |
| 4,239,006 | 12/1980 | Kelson | 102/522 |
| 4,574,703 | 3/1986 | Halverson | 102/520 |
| 4,770,101 | 9/1988 | Robertson et al. | 102/489 |
| 4,800,816 | 1/1989 | Meyer | 102/523 |

*Primary Examiner*—Charles T. Jordan

*Attorney, Agent, or Firm*—Saul Elbaum; Jason M. Shapiro

[57] ABSTRACT

A sabot comprised of a frangible material, having a substantially smooth outer surface, and an inner surface which accommodates one or more penetrators. The sabot is capable of surviving gun launching and flight without disintegration. In one embodiment the sabot is comprised of a material which will disintegrate upon impact with a cardboard sheet having a thickness of 0.05" to 0.10" when travelling at a velocity between 4920 and 6890 feet per second. A preferred material is nylon 6/6. In another embodiment the sabot forms an aerodynamic shell about the penetrator or penetrators, allowing disks and other aerodynamically unstable penetrators to be launched.

9 Claims, 1 Drawing Sheet

FRANGIBLE SABOT

GOVERNMENTAL INTEREST

The invention described herein may be manufactured, used and licensed by or for the U.S. Government for governmental purposes without the payment to us of any royalties thereon.

BACKGROUND OF THE INVENTION

The present invention relates to devices for launching and delivering subcaliber projectiles. More particularly, the present invention relates to a frangible, non-petalling sabot, for use with experimental anti-armor penetrators.

A sabot is used to propel a subcaliber projectile at high velocity from a gun barrel. Conventional sabots may be provided with a cup-like recess for the projectile (push-launch), or with circumferential grooves to mate with corresponding projections on the projectile (traction-launch). Both types are cut longitudinally into four petals which separate from the projectile shortly after exiting the muzzle. Aerodynamic scoops are typically machined into the front of the sabot to induce sabot petal discard in air.

In an experiment, the multi-petal sabot and penetrator leave the muzzle of the gun, at which time the sabot petals open along pre-formed sections and begin to rotate away from the penetrator because of aerodynamic forces acting upon the petals. This releases the penetrator and permits it to continue towards the target without the sabot. In order for the penetrator to achieve proper flight behavior, it must be aerodynamically stable (i.e. it must not tumble during flight). At some point before impact, the penetrator flies through an opening in a steel plate, referred to as a sabot stripper plate, and proceeds toward the target. The sabot petals impact the periphery of the sabot stripper plate after discard. Petal impact with the stripper plate usually results in appreciable damage to the sabot stripper plate, which must be replaced periodically. In addition, the discard event may affect the flight of the penetrator, particularly when a non-symmetric petal-discard motion is induced. This, in turn, can lead to the penetrator impacting the target with a tipped attitude, resulting in decreased penetrator performance.

A thin sheet of cardboard which has a electrically conductive etching on it serves as a projectile enunciator. This sheet, sometimes referred to as a break screen, is placed between the sabot stripper plate and the target. The sheet is used to complete an electrical circuit, which when broken by penetrator impact triggers the penetrator image forming instrumentation.

SUMMARY OF THE INVENTION

Accordingly, it is an object of the present invention to provide a sabot which eliminates the need for machining pre-cut petals, grooves, or air scoops, thereby improving in-bore structural integrity of the sabot and improving penetrator performance.

It is another object of the present invention to provide a sabot which does not necessitate replacement of the sabot stripper plate in experiments.

It is yet another object of the present invention to provide a sabot which does not adversely affect the flight of the penetrator because of asymmetric sabot petal discard.

It is still another object of the present invention to provide a sabot which obviates the need for an aerodynamically stable penetrator.

It is another object of the present invention to provide a sabot which does not influence projectile penetration of a target.

These objects and others not specifically enumerated are accomplished with a sabot comprised of a frangible material, having a substantially smooth outer surface, and an inner surface which accommodates one or more penetrators. The sabot is capable of surviving gun launching and flight without disintegration.

In one embodiment the sabot is comprised of a material which will disintegrate upon impact with a cardboard sheet having a thickness of 0.05 " to 0.10" when travelling at a velocity between 4970 and 6890 feet per second. A preferred material is nylon 6/6.

In another embodiment the sabot forms an aerodynamic shell about the penetrator or penetrators, allowing disks and other aerodynamically unstable penetrators to be launched.

BRIEF DESCRIPTION OF THE DRAWINGS

The preferred embodiments of the present invention will be described with reference to the accompanying drawings.

DESCRIPTION OF THE PREFERRED EMBODIMENTS

Figure 1:
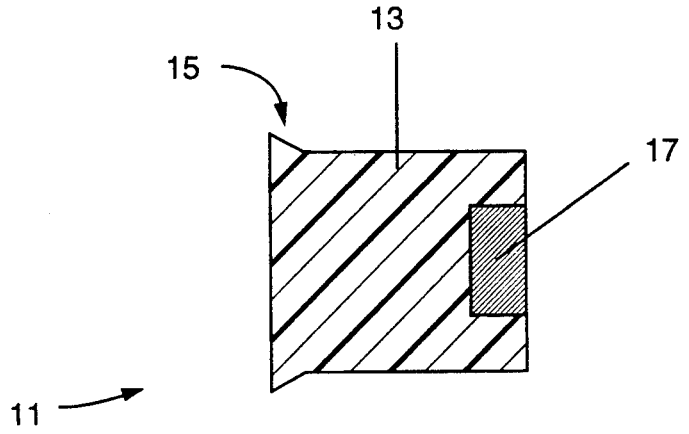
FIG. 1 is a cross-sectional view of a frangible sabot and a single disk-like penetrator.

Referring now to FIG. 1, a sabot 13 is shown carrying a single disk-like penetrator 17. The sabot 13 is comprised of a frangible material, such as nylon 6/6, which will survive gun launching and flight, but which will disintegrate upon impact with a low density target 23 (see FIG. 3). A suitable material for this purpose is ZYTEL ® 101, a polyamide which exhibits tensile and yield strengths of about 12,000 psi, a flexural modulus of approximately 400,000 psi (dry as molded), a compressive strength of about 5,000 psi using ASTM D695, an Izod impact strength of between 1.0 and 2.1 ft.-lb./in. using ASTM D256, and a tensile impact strength of between 200 and 700 ft.-lb./sq. in. using ASTM D1822, all measured at room temperature.

The sabot 13 has forward and aft ends, which may be faced-off or tapered, and an exterior shape which is a surface of revolution about the longitudinal axis. A substantially cylindrical, two-inch diameter sabot 13, illustrated in FIGS. 1 and 2, has been tested successfully with non-aerodynamic coin-like tungsten alloy penetrators 17 having one-inch diameters and thickness between $\frac{1}{8}$ and $\frac{1}{2}$ inch. Although other exterior sabot shapes are possible, the cylindrical outer surface has proven both economical and effective, particularly where the sabot 13 is to be machined rather than formed. Unlike conventional sabots, the frangible sabot 13 is not provided with pre-formed petals or relief cuts, and is made from, or formed as, one piece.

The aft end of the sabot 13 exhibits a ramp 15 which flares outward and serves as an obturating band. If the sabot 13 is a traction-launch type, it is bored-out along its centerline (the longitudinal axis) and tapped to accept a threaded cylindrical penetrator (not illustrated).

When used as a push-launch sabot 13, a blind hole is bored to accept one or more penetrators 17. Alternatively, the sabot 13 may be molded around the penetrator or penetrators 17.

The present invention is particularly useful for launching non-aerodynamic penetrators 17. For instance, coin-like disks having thicknesses between ⅛ and ½ their diameter, have been launched successfully from a conventional 50 mm gun at velocities ranging from 4920 to 6890 feet per second, using frangible sabots 13 two to three inches in length. These penetrators were made from a tungsten alloy and had masses ranging from 0.25 to 8.1 ounces (avoirdupois). On the other hand, a similar sabot carrying a tungsten alloy disk having a thickness equal to its diameter (and weighing approximately 12 ounces) suffered an in-bore failure when launched from the same gun. Thus, the sabot 13 should be designed such that none of the internal stresses developed during acceleration exceed the ultimate strength of the sabot material.

Figure 2:
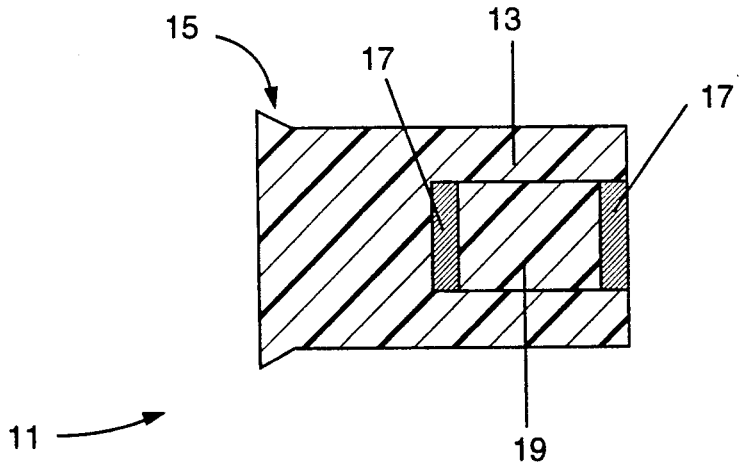
FIG. 2 is a cross-sectional view of a frangible sabot and multiple disk-like penetrators.

The penetrators 17 should be centered on the longitudinal axis of the sabot 13 (i.e. Coaxial) and be located forward of the sabot's center of gravity. When more than one penetrator 17 is to be launched, a spacer 19 should be used to separate the penetrators 17 as shown in FIG. 2. The spacer 19 should be fabricated from the same type of material as the rest of the sabot 13.

Figure 3:
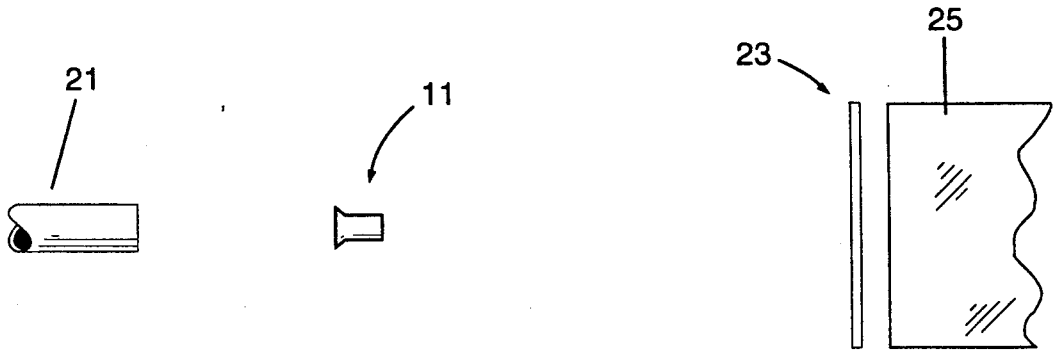
FIG. 3 is a schematic representation of a ballistic experiment in which a frangible sabot is used.

In operation, and as illustrated in FIG. 3, the penetrator or penetrators 17 and the frangible sabot 13 are launched from the gun muzzle 21 together in the direction of a target 25. A thin sheet of cardboard 23 (or some other low density, solid material) is positioned along the path of the munition 11 (the sabot 13 and penetrator 17), and provided with a break screen (not illustrated) to enunciate the arrival of the round, and to trigger appropriate data collection equipment (e.g. cameras, oscilloscopes, computers, etc.). Upon impact with the cardboard, the sabot 13 is made to shatter, and the resulting debris disperses, leaving the penetrator 17 unaffected. The released penetrator 17 then impacts the target 25. In those instances where non-aerodynamic penetrators are to be launched, it is necessary to position the sheet 23 very close to the target (i.e. before the penetrator's flight becomes unstable).

While there has been described and illustrated specific embodiments of the invention, it will be obvious that various changes, modifications and additions can be made herein without departing from the field of the invention which should be limited only by the scope of the appended claims.

We claim:

1. A munition for use in ballistic experiments, said munition comprising one or more penetrators and a sabot comprised of nylon 6/6, said sabot having a substantially smooth outer surface and an inner surface which accommodates said penetrator or penetrators, whereby said sabot will survive launch and flight without separating from said penetrator or penetrators.

2. The invention of claim 1 wherein said nylon 6/6 has an Izod impact strength of between 1.0 and 2.1 foot-pounds per inch measured according to ASTM D 256 at room temperature, and a tensile impact strength of between 200 and 700 foot-pounds per square inch measure according to ASTM D 1822.

3. The invention of claim 1 or 2 wherein said sabot forms an aerodynamic shell about said penetrator or penetrators.

4. The invention of claim 3 wherein said penetrator or penetrators are aerodynamically unstable bodies.

5. The invention of claim 4 wherein said penetrator or penetrators are disks.

6. An apparatus for launch and delivery of an experimental munition, said apparatus comprising:

one or more penetrators;

a sabot comprised of a frangible material, said sabot having a substantially smooth outer surface, and an inner surface which accommodates said penetrator or penetrators, wherein said sabot is capable of surviving gun launching and flight without disintegration;

means to disintegrate said sabot and to trigger data collection equipment immediately prior to impact of said penetrator or penetrators with a target, said disintegration and triggering means constructed so as to permit substantially undisturbed passage of said penetrator or penetrators.

7. The invention of claim 6 wherein said sabot is comprised of nylon 6/6.

8. The invention of claim 7 wherein said nylon 6/6 has an Izod impact strength of between 1.0 and 2.1 foot-pounds per inch measured according to ASTM D 256 at room temperature, and a tensile impact strength of between 200 and 700 foot-pounds per square inch measure according to ASTM D 1822.

9. The invention of claims 6, 7, or 8 wherein said disintegration means is comprised of a cardboard sheet.

* * * * *